United States Patent [19]

Ricart

[11] 4,080,805

[45] Mar. 28, 1978

[54] CAM SYSTEM FOR CIRCULAR KNITTING MACHINES

[76] Inventor: Emilio Llovet Ricart, Roger de Flor Street 16, Mataro, Spain

[21] Appl. No.: 639,816

[22] Filed: Dec. 11, 1975

[30] Foreign Application Priority Data

Dec. 17, 1974 Spain ..... 433.010

[51] Int. Cl.[2] ..... D04B 15/32

[52] U.S. Cl. ..... 66/57; 66/19; 66/54

[58] Field of Search ..... 66/57, 54, 19, 9 A

[56] References Cited

U.S. PATENT DOCUMENTS

| | | | |
|---|---|---|---|
| 2,123,534 | 8/1938 | Lawson et al. | 66/57 |
| 2,475,170 | 7/1949 | Zreve | 66/57 |
| 3,123,991 | 3/1964 | Schmidt | 66/54 |
| 3,386,268 | 6/1968 | Beckenstein | 66/54 |
| 3,421,344 | 1/1969 | Moyer et al. | 66/54 |
| 3,525,239 | 8/1970 | Agulnek | 66/54 |
| 3,854,305 | 12/1974 | Bandoch et al. | 66/54 |
| 3,934,431 | 1/1976 | Westmoreland, Sr. | 66/57 |
| 4,003,221 | 1/1977 | Mischan et al. | 66/57 |

FOREIGN PATENT DOCUMENTS

| | | | |
|---|---|---|---|
| 1,376,779 | 12/1974 | United Kingdom | 66/57 |

*Primary Examiner*—Mervin Stein
*Assistant Examiner*—Andrew M. Falik
*Attorney, Agent, or Firm*—Haseltine, Lake & Waters

[57] ABSTRACT

An arrangement in the cam systems for circular knitting machines in which movable cams having variable positions cooperate with fixed cams to define a needle track, so that this track is substantially free of severe curvatures. The cams cooperate in different working positions to maintain the needle path parallel during the entire track, and independent of the variable position of the movable cams, so as to increase the speed of the dial and needle cylinder of the knitting machine while protecting the dial and needle cylinder against breakage and reducing the number of cam systems to increase the yield of the loom.

5 Claims, 3 Drawing Figures

CAM SYSTEM FOR CIRCULAR KNITTING MACHINES

BACKGROUND OF THE INVENTION

The present invention relates to improvements in the cam systems for circular knitting machine.

The cam systems, as known in the prior art, provide a path for the needles, which has pronounced or severe curves. As a result of such severe curvatures in the needle path, substantially high speed cannot be applied to the plate and to the needle cylinder, since these break under such speeds.

Accordingly, it is an object of the present invention to provide an arrangement which avoids the preceding disadvantages and allows variation in the relationship between the cam systems and the speed.

A further object of the present invention is to provide an arrangement as described, which is simple in design and construction, and may be economically fabricated.

A still further object of the present invention is to provide an arrangement, as described, which may be readily serviced in operation, and has a substantially long operating life.

SUMMARY OF THE INVENTION

An arrangement in the cam systems for circular knitting machine, in which movable cams having variable positions, cooperate with fixed cams to define a needle track which is substantially free of pronounced or severe curvatures. The cams cooperate in different working positions to maintain the needle path parallel during the entire track, and independent of the variable positions of the movable cams. The arrangement results in an increase in the speed of the dial and needle cylinder of the knitting machines, while protecting the dial and needle cylinder against breakage. The number of cam systems are simultaneously reduced, while the yield of the loom is increased.

The length of the knit is regulated by providing a support plate with a micrometer which abuts a gauge block. The latter is abutted by a spring which acts on the gauge block in a direction opposite to that of the micrometer adjusting device. The gauge block is held in the base of the movable cams which form the knit.

The micrometer adjusting device is in the form of a rotatable screw which moves the gauge block and thereby moves the movable cams to the desired position. Movement of the gauge block by the micrometer screw is carried out against the action of the spring held also in the support plate for the micrometer adjusting device. A locking screw holds, when tightened, the micrometer screw in place after an adjustment has been made.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
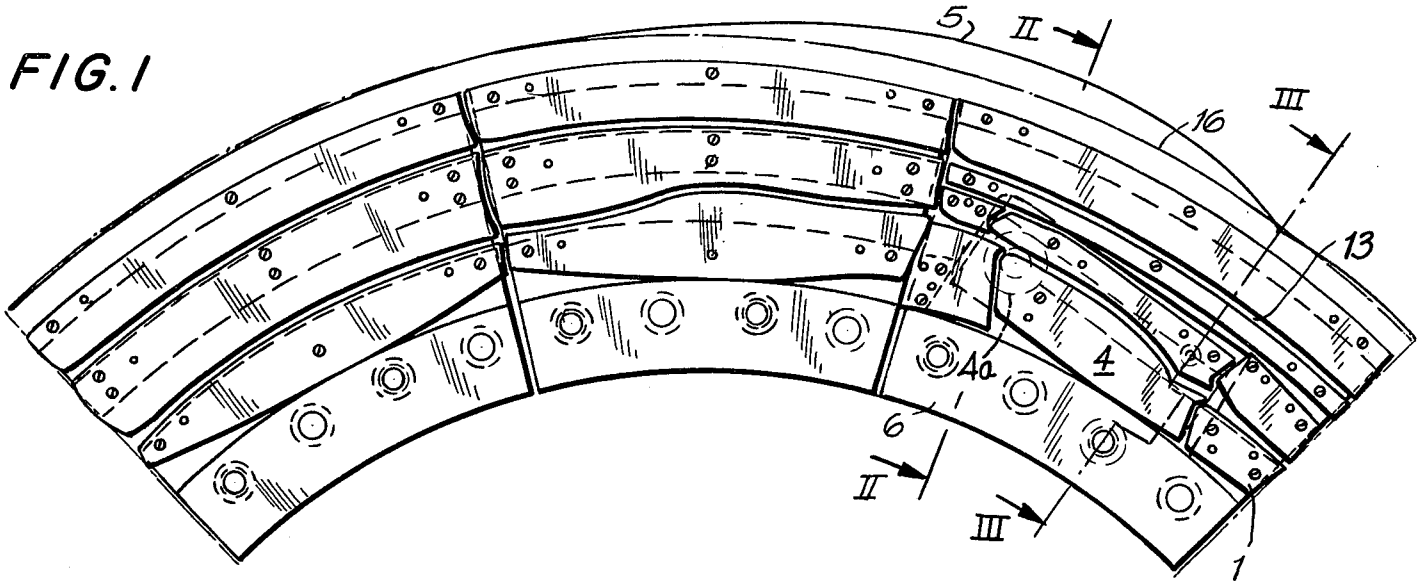
FIG. 1 is a partial plan view and shows the mounting of the cam plate, in accordance with the present invention.

Referring to the drawing, the cam plate moves a multiple of fixed and movable cams mounted on a support plate with an interposed base plate. The movable cams 4 have pivot means **4*a*** and cooperate with the fixed cams to vary the placement of the tracks which the needles are required to follow between the cams.

The fixed cams generally designated by 1 form the tracks 2 in cooperation with the movable cams 4. The needles 3 are caused to follow the tracks 2 by confining the butt **3*a* of the needle along the tracks 2**.

Figure 2:
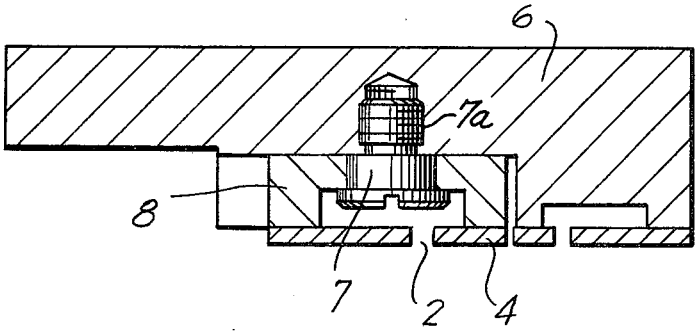
FIG. 2 is a sectional view taken along line II—II in FIG. 1.

With reference to FIG. 2, the lever support plate is identified by reference numeral 6. The reference numeral 7 designates an element which has a portion **7*a* screwed to plate 6. This element provides on its unthreaded part, a pivot which is rotationally mounted on the base member 8. The corresponding lever 4** is mounted thereon, and moves while being joined to that base.

Figure 3:
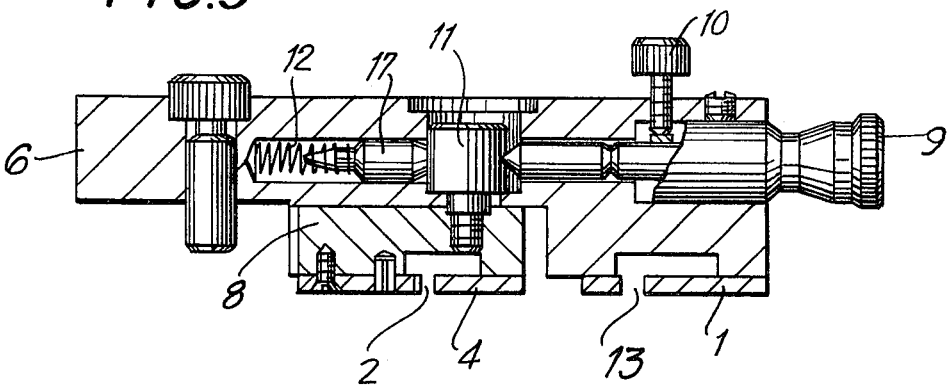
FIG. 3 is a sectional view taken along line III—III in FIG. 1.

The improvements of the present invention move a mechanism for regulating the length of the knit, which may be seen in FIG. 3. This mechanism includes a micrometer adjustment member 9, a screw 10 for locking the micrometer in place, and a gauge block 11 abutted by the micrometer means. A spring 12 also acts on the gauge block 11, in a direction which is opposite to the action of the micrometer 9 on the gauge block. This mechanism causes the lever 4 to oscillate or undergo reciprocable motion and vary the position of the movable cams with respect to the fixed cams. For this purpose, rotation is accomplished in one direction by means of the micrometer adjusting element 9 which applies a force to block 11 and produces compression of spring 11 through element 17. At the same time, base No. 8 acting as a movable lever is rotated in one direction. When rotation is effected in the opposite direction by means of the micrometer adjusting element No. 9, the spring extends and applies a force so as to rotate the moveable lever base 8 in the opposite direction, through element 17 and block 11. In FIG. 3, the movable cam base is indicated by the reference numeral 8, and the micrometer support member and the fastening gauge of the support plate system is designated by 6.

The improvements of the present invention provide for the track 2 where the needles are guided by their butt **3*a* to form the knit, in contrast to the neutral track 13** formed between the fixed cams, where the needles do not operate.

In FIG. 1, the circumference of the needle dial is designated by the reference numeral 16, and the borderline of the needle path is designated by 5.

The placement and the number of systems (required needle track to form the knit) is made variable in accordance with the given needed requirements and applications.

The systems as provided in accordance with the present invention and shown in the drawings, provides for increasing the approximate speed of 25 rpm in conventional knitting machines, to substantially 100–200 rpm. This increase in speed allows significant increase in the production rate by increasing 400–800% the speed available with conventional machines.

The construction of the cam systems for the needle cylinder is similar to that of the dial, and is for this reason not illustrated.

The present invention can provide, furthermore, for several movable cams among each other, with similar tracks, according to the number of needle butts related to the type of machines being used.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. An arrangement in the dial cam systems for circular knitting machines comprising fixed cam means; movable cam means having variable positions for changing stitch length and cooperating with said fixed cam means to define a needle running path, said movable cam means having a configuration conforming to respective tracks substantially slightly curved and free of substantial angular projections so that the tracks are substantially straight paths for the needles, said movable cam means cooperating in different working positions to maintain the needle path parallel during the entire track and independent of the variable position of said movable cam means for increasing the speed of the dial against breakage and while reducing the number of cam systems and increasing the yield of the knitting machine.

2. An arrangement in the cam systems for circular knitting machines comprising fixed cam means; movable cam means having variable positions and cooperating with said fixed cam means to define a needle running path, said needle running path being substantially free of severe curvatures, said cam means cooperating in different working positions to maintain the needle path parallel during the entire track and independent of the variable position of said movable cam means for increasing the speed of the dial and needle cylinder of the knitting machine while protecting said dial against breakage and while reducing the number of cam systems and increasing the yield of the knitting machine, means for regulating the length of the stitch; micrometer means; gage means abutted by said micrometer means; spring means abutting said gage means, said spring means acting on said gage means in a direction opposite to that of said micrometer means, said gage means being held in the base of said movable cam means.

3. The arrangement as defined in claim 2 including locking screw means for locking said micrometer means in place; pivot means for pivoting said movable cams; and support means for supporting said movable cam means and said pivot means.

4. An arrangement in the cam systems for circular knitting machines comprising fixed cam means; movable cam means having variable positions and cooperating with said fixed cam means to define a needle running path, said movable cam means having a configuration conforming to respective tracks substantially slightly curved and free of substantial angular projections so that the tracks are substantially straight paths for the needles, said cam means cooperating in different working positions to maintain the needle path parallel during the entire track and independent of the variable position of said movable cam means for increasing the speed of the dial against breakage and while reducing the number of cam systems and increasing the yield of the knitting machine; means for regulating the length of the stitch; micrometer means; gage means abutted by said micrometer means; spring means abutting said gage means, said spring means acting on said gage means in a direction opposite to that of said micrometer means, said gage means being held in the base of said movable cam means.

5. The arrangement as defined in claim 4 including locking screw means for locking said micrometer means in place; pivot means for pivoting said movable cams; and support means for supporting said movable cam means and said pivot means.

* * * * *